United States Patent [19]

Kitta et al.

[11] Patent Number: 4,577,443

[45] Date of Patent: Mar. 25, 1986

[54] METALLIC SHEATH FOR POSTTENSIONING METHOD

[75] Inventors: Toshiyuki Kitta, Omiya; Wataru Abe, Hiratsuka; Tadaaki Takase, Fujisawa, all of Japan

[73] Assignee: Oiles Industry Co., Ltd., Tokyo, Japan

[21] Appl. No.: 441,080

[22] Filed: Nov. 12, 1982

[30] Foreign Application Priority Data

Nov. 13, 1981 [JP] Japan ..... 56-181187

[51] Int. Cl.[4] ..... E04C 5/12

[52] U.S. Cl. ..... 52/230

[58] Field of Search ..... 52/230, 223 L; 24/122.6; 264/228

[56] References Cited

U.S. PATENT DOCUMENTS

| | | | |
|---|---|---|---|
| 3,672,712 | 6/1972 | Davis | 24/122.6 |
| 3,833,706 | 9/1974 | Edwards | 52/230 |
| 3,909,424 | 9/1975 | Clark | 252/12 |
| 4,068,963 | 1/1978 | Brandestini | 52/223 L |
| 4,189,522 | 2/1980 | Mori | 428/557 |
| 4,361,629 | 11/1982 | Mori | 75/231 |
| 4,434,063 | 2/1984 | Kageyama | 252/25 |
| 4,442,646 | 4/1984 | Prevedini | 52/230 |

*Primary Examiner*—John E. Murtagh
*Assistant Examiner*—Kathryn Ford
*Attorney, Agent, or Firm*—Oblon, Fisher, Spivak, McClelland & Maier

[57] ABSTRACT

In a prestressed concrete structure executed by posttensioning method, a metallic sheath having an inner peripheral surface thereof in sliding contact with a tendon coated with a solid lubricating coating including polytetrafluoroethylene (PTFE).

By the use of this metallic sheath, the sliding frictional resistance produced between the metallic sheath and tendon when the tendon is subjected to tensioning operation is considerably decreased to increase the prestressing force introduced into the structure accordingly.

The solid lubricating coating is excellent in flexibility and contact properties, and good characteristics of coating are imparted to the sheath.

8 Claims, 1 Drawing Figure

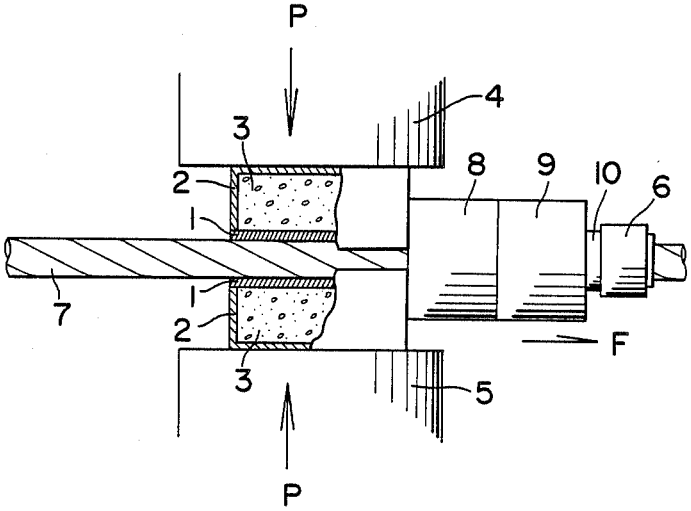
P
4
3
8
9
10
6
2
1
7
1
2
F
3
5
P

METALLIC SHEATH FOR POSTTENSIONING METHOD

BACKGROUND OF THE INVENTION

This invention relates to a metallic sheath used for prestressed concrete structures, and more specifically, to a metallic sheath for a posttensioning method, which is provided with a means for decreasing frictional resistance between a tendon and a metallic sheath when the tendon is subjected to a tensioning operation.

Generally, when a prestressed concrete structure is executed by a posttensioning method, metallic sheathes are normally used because a tendon is arranged. The metallic sheath has a function as a cover for the tendon so that the tendon is insulated from concrete. After the concrete is cured the tendon is tensioned. The metallic sheath allow the tendon to be arranged smoothly, and have strength enough to withstand a collapse thereof or formation of holes therein when the concrete is placed. Frictional resistance resistance must be small when the arranged tendon is prestressed.

In particular, the frictional resistance between the tendon and the metallic sheath, when the tendon is prestressed, ought to be zero unless both the metallic sheath and tendon are arranged in straight and come into contact each other. However, if it is difficult to arrange the tendon and metallic sheath, and in actual practice they have a slight wave or bend, thus producing an unavoidable frictional resistance therebetween. Moreover, when the metallic sheath and tendon are arranged in a curved fashion, a frictional resistance proportional to the bend-up angle is applied thereto, resulting in a greater frictional resistance therebetween. Furthermore, if the internal peripheral surfaces of the metallic sheath and/or tendon are rusted, a greater frictional resistance therebetween results.

Since the frictional resistance produced when the tendon is prestressed appears as a frictional loss in the prestressing force introduced into the tendon, when a predetermined prestress (which is a prestress contemplated in design) is introduced into a concrete structure, the frictional resistance influences thereon as a decrease in said introduced prestressing force. That is, if the frictional resistance is small, a difference between the prestressing force at the end of the tendon and the prestressing force introduced into the tendon decreases, whereby a predetermined prestress may be provided. Conversely, if the frictional force is great, the difference between the prestressing force at the end of the tendon and the prestressing force introduced into the tendon increases, whereby the prestressing force at the end of the tendon must be made greater to provide a predetermined prestress.

Decreasing the frictional resistance is very important as the following effects are caused: (1) the prestressing force effective to the tendon may be introduced over the full length thereof, (2) the number of tendons used may be reduced, (3) the diameter of the tendons used may be reduced, and (4) the limit in length over which the prestressing force is effective to the tendon may be extended.

In view of the foregoing, means for reducing the frictional resistance (for example, water-soluble oil or soapy water is poured into the sheath, and the like) have been heretofore proposed. However, the previously used methods suffer from various disadvantages. The effect of lowering friction is small (in case of water-soluble oil, the coefficient of friction is 0.29), and is immediately lost. Moreover, the characteristics of the metallic sheath itself (flexibility, hardness or the like) are impaired, and the work required is time consuming.

SUMMARY OF THE INVENTION

From the results of various studies, the present invention has been developed. In a prestressed concrete structure executed by a posttensioning method, a solid lubricating coating such as polytetrafluoroethylene is applied to an inner peripheral surface of a metallic sheath in sliding contact with a tendon when the tendon is prestressed, whereby a frictional resistance produced between the tendon and the metallic sheath may be materially decreased to minimize the difference between a prestressing force at the end of the tendon and a prestressing force introduced into the tendon.

That is, the present invention provides a metallic sheath for a posttensioning method wherein a solid lubricating coating including polytetrafluoroethylene resin is applied to an inner peripheral surface in sliding contact with the tendon when the latter is prestressed.

The aforesaid solid lubricating coating is applied in the form of a thin film between the metallic sheath and the tendon inserted into said metallic sheath to decrease the frictional resistance produced therebetween when the tendon is prestressed. In the present invention, the solid lubricating coating applied in the form of a thin film to the inner peripheral surface of the metallic sheath, said coating comprising a mixture of polytetrafluoroethylene resin (hereinafter referred to as PTFE) and soft metal and (or) metal sulfide, greatly decreasing the frictional resistance therebetween when the tendon is prestressed.

The simplest method employed for applying the solid lubricating coating in the form of a thin film to the inner peripheral surface of the metallic sheath comprises adding a binder to PTFE or a mixture of PTFE and soft metal and (or) metal sulfide, suspending the same into a volatile solvent to make a suspension, and applying said suspension in a spray system.

The metallic sheath for posttensioning in accordance with the present invention has various excellent effects as follows:

(1) In accordance with the present metallic sheath, the sliding frictional resistance produced between the metallic sheath and the tendon when the latter is subjected to a tensioning operation may be decreased considerably to an extent not expected with previously used methods.

(2) In accordance with the present metallic sheath, the prestressing force introduced into the structure is hardly lowered, and the prestressing force is introduced substantially uniformly. In addition, the longer the length of the tendon, the more this tendency is conspicuous.

(3) In accordance with the present metallic sheath, as the solid lubricating coating applied to the inner peripheral surface is extremely thin, the flexibility of the metallic sheath itself is not impaired. The coating has good contact properties and is difficult to peel off, and therefore, the metallic sheath can be coated by a coating having good coating characteristics.

(4) The solid lubricating coating for the present metallic sheath has the rust-proofing effect.

BRIEF DESCRIPTION OF THE DRAWING

Other objects, features and attendant advantages of the present invention will become more fully appreciated as the same becomes better understood from the following detailed description when considered in connection with the accompanying drawing in which like reference characters designate like or corresponding parts and wherein:

The single FIGURE is a partly longitudinal section view of a testing device for measuring the coefficient of friction of a metallic sheath, showing an embodiment of the present invention.

DETAILED DESCRIPTION OF THE INVENTION

PTFE which forms a solid lubricating coating must be a fine powder as fine as possible, with an average grain size of which is preferably smaller than 5 microns. In particular good fine powder products are Fluon (name of goods) of ICI in England, or Hostaflon (name of goods) of Hoechst in West Germany. These PTFE fine powders have an apparent density of 0.3–0.5 gr/cm$^3$, a specific gravity of 2.10–2.29 and a dry coefficient of friction of 0.02–0.10. They have some of the flocculating properties of powder which are manifested in said powder and can be dispersed well in a dispersant medium, unlike general PTFE powder. This PTFE may be used independently or as a mixture to be described.

Soft metals which may be used include lead (Pb), tin (Sn), zinc (Zn), and cadmium (Cd). One or two or more may be mixed with said PTFE. Metal sulfides which may be used include molybdenum disulfide ($MoS_2$) and tungsten disulfide ($WS_2$). One or both may be mixed with said PTFE or PTFE and soft metal.

The aforesaid soft metal and metal sulfide must be a fine powder as fine as possible as must be the PTFE. The soft metal preferably comprises a fine powder which passes through approximately 250 mesh, and the metal sulfide preferably comprises a fine powder having an average grain size of approximately 5–8 microns. These soft metal and metal sulfide may be individually or simultaneously mixed with PTFE and are coated on the contact portion between the tendon and metallic sheath. The soft metal and metal sulfide have an extremely great rupture strength and being present on the sliding contact surface they prevent direct contact between metals. The soft metal and metal sulfide also serve as a carrier for holding the PTFE fine powder on the frictional sliding contact surface to render the low coefficient of friction of PTFE more effective. PTFE and soft metal and/or metal sulfide exhibit a geometrical effect, and it has been found by experiment that the ratio of amounts used may be determined approximately by using the equalized amount in capacity ratio as a standard.

The aforementioned binder of a mixture of PTFE or PTFE and soft metal and/or metal sulfide includes alkyd resin, particularly, Styresol (name of the goods) of Dai Nippon Ink & Chemical Inc., which is a styrenated alkyd in which styrene is grafted into an unsaturated group of said alkyd. This material is quick-drying and has a high adhesive ability, and in use, it can be dried at normal temperature or can be printed. Solvents for said styrenated alkyd normally include xylene, or mineral turpentine, however xylene, dichloroethane, trichloroethylene, trichloroethane or a mixture of these are preferred.

The compounding ratio in volume (VOL%) of components except solvent is (1) 50–70% of PTFE fine powder and 30–50% of styrenated alkyd, and (2) 20–60% of PTFE fine powder, 10–50% of soft metal and/or metal sulfide and 30–70% of styrenated alkyd. It has been determined by experiments that said materials are preferably added to the solvent and agitated and mixed, and then applied as a coating of 20–100 microns thickness to the inner peripheral surface of a metallic sheath by a spray system. This provides good contact with the inner peripheral surface of the metallic sheath and decreases the frictional resistance between the metallic sheath and tendon.

The present invention will be further illustrated by certain examples and references which are provided for purposes of illustration only and are not intended to limit the present invention.

EXAMPLE I

PTFE fine powder (Hoechst: Hostaflon NLP29F) having an apparent density of 0.3–0.5 gr/cm$^3$ (true specific gravity: 2.25–2.29) and an average grain size of 5 microns or less is added to and agitated in a styrenated alkyd—trichloroethane solution, which is then applied uniformly in the form of a solid lubricating coating of 20 microns thickness to the inner peripheral surface of the metallic sheath by the spray system.

EXAMPLE II

PTFE fine powder similar to Example I and soft metal which passes through 250 meshes are added to and agitated in a styrenated alkyd—trichloroethane solution, which is then applied uniformly in the form of a solid lubricating coating of 20 microns thickness to the inner peripheral surface of the metallic sheath by the spray system in a manner similar to that of Example I.

EXAMPLE III

PTFE fine powder similar to Example I and metal sulfide of average grain size 5–8 microns are added to and agitated in a styrenated alkyd—trichloroethane solution, which is then applied uniformly in the form of a solid lubricating coating of 20 microns thickness to the inner peripheral surface of the metallic sheath by the spray system in a manner similar to that of Example I.

EXAMPLE IV

PTFE fine powder, soft metal and metal sulfide similar to Example I, Example II and Example III are added to and agitated in a styrenated alkyd—trichloroethane solution, which is then applied uniformly in the form of a solid lubricating coating of 20 microns thickness to the inner peripheral surface of the metallic sheath by the spray system in a manner similar to that of Example I.

One illustration of the components except solvent of the solid lubricating coatings obtained by the aforementioned Examples is provided in Table 1.

TABLE 1

| | | (Volume %) Component composition | | | | | | | |
|---|---|---|---|---|---|---|---|---|---|
| | | | Soft Metal | | | | Metal Sulfide | | Styrenate |
| Example | | PTFE | Pb | Sn | Zn | Cd | $MoS_2$ | $WS_2$ | alkyd |
| I | 1 | 50 | — | — | — | — | — | — | 50 |
| | 2 | 70 | — | — | — | — | — | — | 30 |

TABLE 1-continued

| Example | | (Volume %) Component composition | | | | | | | |
|---|---|---|---|---|---|---|---|---|---|
| | | | Soft Metal | | | | Metal Sulfide | | Styrenate |
| | | PTFE | Pb | Sn | Zn | Cd | $MoS_2$ | $WS_2$ | alkyd |
| II | 1 | 40 | 30 | — | — | — | — | — | 30 |
| | 2 | 40 | 20 | — | 10 | — | — | — | 30 |
| | 3 | 40 | — | 15 | — | 15 | — | — | 30 |
| | 4 | 30 | 40 | — | — | — | — | — | 30 |
| III | 1 | 40 | — | — | — | — | 30 | — | 30 |
| | 2 | 40 | — | — | — | — | — | 30 | 30 |
| | 3 | 40 | — | — | — | — | 15 | 15 | 30 |
| | 4 | 30 | — | — | — | — | 40 | — | 30 |
| IV | 1 | 40 | 15 | — | — | — | 15 | — | 30 |
| | 2 | 30 | 20 | — | — | — | 20 | — | 30 |
| | 3 | 15 | — | — | — | — | — | 15 | 30 |
| | 4 | 30 | 20 | — | — | — | — | 20 | 30 |

The testing method used to measure the frictional resistance between the metallic sheath having the inner peripheral surface coated with the solid lubricating coating having the aforementioned composition of components and the tendon inserted into said metallic sheath, and the results thereby obtained will now be described.

SAMPLES USED

1. A spiral Sheath (Kogen Kizai: name of goods) having an inside diameter of 35 mm and a wall thickness 0.23 mm was used, as the metallic sheat, and a solid lubricating coating of 20 microns thickness having the composition of components in said Example I—1, Example II—1, Example II—4, Example III—1, Example III—3, Example IV—1, and Example IV—4 was applied to the inner peripheral surface of said metallic sheath.

2. A tendon twisted wire consisting of 19 wires having a diameter 21.8 mm was used as the tendon.

TESTING METHOD

A testing apparatus as shown in the single FIGURE was used to conduct the testing method.

A sheath 1 of length 10 cm was prepared and divided into two sections in a longitudinal direction, which were arranged in steel mold frames 2, 2, respectively. Thereafter, concrete 3, 3 was poured into said mold frames 2, 2 to secure the sheathes 1, 1 to said mold frames 2, 2. The steel mold frames 2, 2 having the sheathes 1, 1 secured thereto were opposed to each other and secured to upper board 4 and lower board 5 of an Amsler universal testing machine, and a tendon twisted wire 7 having a fixture 6 fastened to an end thereof was inserted between said sheathes 1 and 1 with the tendon twisted wire 7 held between the sheathes 1 and 1. Fitted and arranged on the tendon twisted wire 7 and projected from the steel mold frames 2, 2 were a load cell 8 in abutment with the ends of the mold frames 2, 2 and a jack 9 between the load cell 8 and the fixture 6 of the tendon twisted wire 7. A cylinder 10 of the jack 9 is brought into abutment with the fixture 6.

With this arrangement, perpendicular loads P (1300 kg) were loaded on the sheathes 1, 1 and the steel tendon twisted wire 7 held between said sheathes and thereafter the jack 9 was actuated to press the fixture 6 by the cylinder 10 of the jack 9 and a horizontal force F was loaded on the steel tendon twisted wire 7.

This horizontal force F was turned into a sliding frictional resistance between the steel tendon twisted wire 7 and the inner peripheral surfaces of the sheathes 1, 1 with respect to the perpendicular load P, which resistance was detected by the load cell 8 and recorded in a recorder, and the coefficient of friction between the sheathes and the tendon twisted wire was obtained from said resistance and perpendicular load.

It was noted that the perpendicular load P (1300 kg) was such that the bending radius of steel material in case the tendon is arranged in a curved fashion must be more than 100 times that of the inside diameter of the sheath. Such a bending radius could also be determined from the allowable tensile stress of the tendon used for testing.

The sheath was arranged in a curved fashion with the radius of curvature being 100 times (3500 mm) the inside diameter 35 mm of the sheath used for testing. The 19-wire tendon twisted wire of diameter 21.8 mm was inserted into the sheath. Then, the perpendicular load per unit length of the sheath produced when the tendon twisted wire was tensioned by the allowable tensile stress 45450 kg was obtained from theoretical calculation.

The coefficient of friction between the sheath and the tendon twisted wire obtained by the aforesaid testing method is given by Table 2.

TABLE 2

| Sample | | Perpendicular load kg 1.300 |
|---|---|---|
| Examples | I-1 | 0.14 |
| | II-1 | 0.12 |
| | II-4 | 0.11 |
| | III-1 | 0.13 |
| | III-3 | 0.13 |
| | IV-1 | 0.12 |
| | IV-4 | 0.13 |
| Comparision Example | I | 0.40 |
| | II | 0.50 |

In Table 2, Comparison Example I indicates the coefficient of friction between Spiral Sheath (name of goods) with the inner peripheral surface not coated with the solid lubricating coating and the tendon twisted wire, and Comparison Example II indicates the coefficient of friction between said sheath with the inner peripheral surface not coated with the solid lubricating coating and the tendon twisted wire with rust produced (the tendon twisted wire is left in the atmosphere to produce rust).

It is found from the test results that the sheath with the inner peripheral surface coated with the solid lubricating coating has considerably decreased frictional resistance (coefficient of friction) as compared to the sheath not coated with the solid lubricating coating.

The magnitude of the frictional resistance between the metallic sheath and the tendon is important as being influenced by the prestressing force introduced into the tendon, which will be described hereinafter.

In designing the prestressed concrete structure, the prestressing force introduced into the tendon is calculated in design value by the following equation.

$$Pi = (1 + \gamma) \cdot e^{\mu(\alpha + \frac{\lambda}{\mu} l)} \cdot Pj$$

In the above equation,

Pi: prestressing force of the end of the tendon

Pj: prestressing force introduced into the tendon in the center of span $\gamma$: internal coefficient of friction between the tendon and the fixture, and the jack for tensioning the tendon or pump $\lambda$: coefficient of friction per length 1 m produced when the tendon and metallic sheath are arranged in straight and the tendon is tensioned $\mu$: coefficient of friction proportional to the bend-up angle of the tendon $\alpha$: bend-up angle (radian) of the tendon l: length of tendon from the center of span to the front of the fixture In the above equation, $\gamma$ and $$\frac{\lambda}{\mu}$$

can be generally considered having the constant values of $\gamma=0.04$, $$\frac{\lambda}{\mu} = 0.0133.$$

Here, the coefficient of friction (corresponding to $\mu$ in the above equation) obtained from the aforementioned test result was substituted for the above equation, and the loss introduction ratio due to the frictional resistance of the prestressing force Pj introduced into the tendon in the center of span with respect to the prestressing force Pi of the end of the tendon was obtained by varying the bend-up angle of the tendon. The results are given in Table 3 with $$\frac{Pj}{Pi} \times 100\ (\%).$$

When the frictional loss between the aforesaid tendon and metallic sheath is taken into consideration, the effective tensile stress $\sigma$pe acting on the tendon in the using state of the structure was obtained by the following calculation.

The effective tensile stress $\sigma$pe is calculated from the following equation.

$$\sigma_{pe} = \eta \cdot \sigma_{pa} = \frac{Pj}{Pi}$$

where $\eta$: effective factor of the prestressing force when the relaxation of tendon (when tension is imparted to the tendon to maintain strain at constant, a decrease in stress which occurs as the time passes) and creep and drying and shrinkage are taken into consideration $\sigma$pa: maximum tensile stress exerted on the end of the tendon during the prestressing In the above equation, the coefficient of effective prestress introduction $\eta$ was set to 0.8, and the maximum tensile stress $\sigma$pa was set to 0.9 $\sigma$py because the allowable value of tension of the tendon which is temporarily acting can be increased to whichever smaller value, 0.8 $\sigma$py (tensile stress of tendon) or 0.9 $\sigma$py (yield point stress of tendon). If $\sigma$py=0.86 $\sigma$pu, the above equation may be rewritten by $$\sigma_{pe} = 0.8 \cdot 0.9 \cdot 0.86 \cdot \sigma_{pu} \cdot \frac{Pj}{Pi}$$

$$= 0.62\ \sigma_{pu} \cdot \frac{Pj}{Pi}$$

It may be seen from the above formula that if $$\frac{Pj}{Pi} = 1,$$

that is, if no frictional loss is present, the effective tensile stress $\sigma$pe exerted on the tendon after completion of fixation has 62% of tensile strength $\sigma$pu of the tendon. Accordingly, if $$\frac{Pj}{Pi}$$

is close to 1, in other words, if the frictional resistance (coefficient of friction) between the tendon and the metallic sheath when the tendon is prestressed is smaller, the effective tensile stress $\sigma$pe may be increased.

The results obtained when the metallic sheath of the present invention is used with the above formula are shown in Table 3 with $\sigma$pe.

It may be seen from the above-described results that the metallic sheath with the inner peripheral surface coated with the solid lubricating coating rarely lowers the prestressing force introduced into the end of the tendon in the center of the span and can even introduce a substantial prestressing force.

Accordingly, when a predetermined prestress is imparted to the concrete structure, the use of the metallic sheath having the inner peripheral surface thereof coated with the solid lubricating coating permits a reduction in the number of tendons used, the use of tendons which are smaller in diameter, and an extension of the length which is capable of tensioning the tendon.

The invention may be embodied in other specific forms without departing from the spirit or essential characteristics thereof.

The present embodiment is therefore to be considered in all respects as illustrative and not restrictive, the scope of the invention being indicated by the appended claims rather than by the foregoing description and all changes which come within the meaning of the claims, and are equivalent thereto, are therefore intended to be embraced therein.

TABLE 3

| Coefficient of friction $\mu$ | Bend-up angle $\alpha$(radian) | Length of Tendon 60 m $\frac{Pj}{Pi} \times 100\%$ | 60 m $\sigma_{pe}$ | 100 m $\frac{Pj}{Pi} \times 100\%$ | 100 m $\sigma_{pe}$ |
|---|---|---|---|---|---|
| 0.14 | 0.087(5°) | 90 | 0.56 × $\sigma$pu | 87 | 0.54 × $\sigma$pu |
| | 0.349(20°) | 87 | 0.54 × $\sigma$pu | 83 | 0.51 × $\sigma$pu |
| | 0.524(30°) | 84 | 0.52 × $\sigma$pu | 81 | 0.50 × $\sigma$pu |
| | 0.873(50°) | 80 | 0.50 × $\sigma$pu | 78 | 0.48 × $\sigma$pu |
| | 1.745(100°) | 71 | 0.44 × $\sigma$pu | 69 | 0.43 × $\sigma$pu |
| 0.11 | 0.087(5°) | 91 | 0.56 × $\sigma$pu | 89 | 0.55 × $\sigma$pu |
| | 0.349(20°) | 89 | 0.55 × $\sigma$pu | 86 | 0.53 × $\sigma$pu |

TABLE 3-continued

| Coefficient of friction $\mu$ | Bend-up angle $\alpha$(radian) | Length of Tendon 60 m $\frac{Pj}{Pi} \times 100\%$ | 60 m $\sigma_{pe}$ | 100 m $\frac{Pj}{Pi} \times 100\%$ | 100 m $\sigma_{pe}$ |
|---|---|---|---|---|---|
| | 0.524(30°) | 87 | $0.54 \times \sigma_{pu}$ | 84 | $0.52 \times \sigma_{pu}$ |
| | 0.873(50°) | 84 | $0.52 \times \sigma_{pu}$ | 81 | $0.50 \times \sigma_{pu}$ |
| | 1.745(100°) | 76 | $0.47 \times \sigma_{pu}$ | 74 | $0.46 \times \sigma_{pu}$ |
| 0.40 | 0.087(5°) | 79 | $0.49 \times \sigma_{pu}$ | 71 | $0.44 \times \sigma_{pu}$ |
| | 0.349(20°) | 71 | $0.44 \times \sigma_{pu}$ | 64 | $0.40 \times \sigma_{pu}$ |
| | 0.524(30°) | 66 | $0.41 \times \sigma_{pu}$ | 60 | $0.37 \times \sigma_{pu}$ |
| | 0.873(50°) | 58 | $0.36 \times \sigma_{pu}$ | 52 | $0.32 \times \sigma_{pu}$ |
| | 1.745(100°) | 41 | $0.25 \times \sigma_{pu}$ | 37 | $0.23 \times \sigma_{pu}$ |

What is claimed is:

1. A metallic sheath for use in a posttensioning method, said sheath having an inner peripheral surface thereof coated with a solid lubricating coating comprising 20–60 vol % of polytetrafluoroethylene, 10–50 vol % of a soft metal, a metal sulfide or a mixture thereof, and 30–70 vol % of styrenated alkyd as a binder.

2. The metallic sheath of claim 1, wherein said soft metal is a member selected from the group consisting of lead, tin, zinc, cadmium and mixtures thereof.

3. The metallic sheath of claim 1, wherein the metal sulfide is a member selected from the group consisting of molybdenum disulfide, tungsten disulfide and mixtures thereof.

4. The metallic sheath of claim 1, wherein said polytetrafluoroethylene comprises a polytetrafluoroethylene having an average grain size of less than 5 microns.

5. The metallic sheath of claim 1, wherein said solid lubricating coating has a thickness of about 20 to 100 microns.

6. The metallic sheath of claim 1 or 2, wherein said soft metal comprises a soft metal powder which passes through a screen of approximately 250 mesh.

7. The metallic sheath of claim 1 or 3, wherein said metal sulfide comprises a metal sulfide having an average grain size of about 5 to 8 microns.

8. Metallic sheath for use in a posttensioning method, said sheath having an inner peripheral surface thereof coated with a solid lubricating coating, comprising:

(a) 20–60 volume percent of polytetrafluoroethylene;

(b) 10–50 volume percent of a soft metal selected from the group consisting of lead, tin, zinc, cadmium and mixtures thereof, a metal sulfide selected from a group consisting of molybdenum disulfide, tungsten disulfide and mixtures thereof, or a mixture of one of said soft metals and one of said metal sulfides; and (c) 30–70 volume percent of a styrenated alkyd as a binder.

* * * * *